US008045885B2

(12) United States Patent
Gunbe

(10) Patent No.: US 8,045,885 B2
(45) Date of Patent: Oct. 25, 2011

(54) PROCESSING UNIT FOR IMAGE FORMING APPARATUS

(75) Inventor: Eiji Gunbe, Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 372 days.

(21) Appl. No.: 12/206,400

(22) Filed: Sep. 8, 2008

(65) Prior Publication Data

US 2009/0074448 A1 Mar. 19, 2009

Related U.S. Application Data

(60) Provisional application No. 60/972,234, filed on Sep. 13, 2007.

(51) Int. Cl.
*G03G 21/18* (2006.01)

(52) U.S. Cl. ..... 399/113; 399/121

(58) Field of Classification Search ..... 399/111, 399/112, 113, 121, 302, 308
See application file for complete search history.

(56) References Cited

U.S. PATENT DOCUMENTS

| | | | | |
|---|---|---|---|---|
| 4,943,828 | A * | 7/1990 | Manabe et al. | 399/113 |
| 6,708,011 | B2 * | 3/2004 | Nomura et al. | 399/110 |
| 6,751,428 | B2 * | 6/2004 | Okabe | 399/111 |
| 6,807,393 | B2 * | 10/2004 | Sameshima et al. | 399/113 |
| 6,937,834 | B2 * | 8/2005 | Kanno et al. | 399/114 |
| 7,020,415 | B2 * | 3/2006 | Abe | 399/110 |
| 7,031,638 | B2 * | 4/2006 | Tanizaki et al. | 399/112 |
| 7,113,724 | B2 * | 9/2006 | Park et al. | 399/112 |
| 7,130,561 | B2 * | 10/2006 | Iikura et al. | 399/111 |
| 7,187,887 | B2 * | 3/2007 | Inaba | 399/113 |

FOREIGN PATENT DOCUMENTS

JP 07199650 A * 8/1995

* cited by examiner

*Primary Examiner* — Robert Beatty
(74) *Attorney, Agent, or Firm* — Patterson & Sheridan, LLP

(57) ABSTRACT

According to an embodiment of the invention, slide rails guided by guide rails of a body frame are provided on an EPU frame. A slidable bolt is provided on a belt unit frame. When the belt unit is attached to or removed from the body frame, the bolt is fitted into an insertion port of the EPU frame and the EPU frame is connected with the belt unit frame. The slide rails of the EPU frame are used to integrally attach and remove the belt unit and the EPU to and from the body frame.

18 Claims, 5 Drawing Sheets

PROCESSING UNIT FOR IMAGE FORMING APPARATUS

CROSS-REFERENCE TO RELATED APPLICATION

This application is based upon and claims the benefit of priority from prior U.S. Provisional Application 60/972,234 filed on Sep. 13, 2007, the entire contents of which are incorporated herein by reference.

TECHNICAL FIELD

The present invention relates to a processing unit for an image forming apparatus attachable to and removable from a copy machine, printer and so on that forms an image by using an electrophotographic system.

BACKGROUND

As an electrophotographic image forming apparatus such as a copy machine or printer, an apparatus having an electrophotographic process unit (hereinafter abbreviated as EPU) and a belt unit, each of which is attachable to and removable from the image forming apparatus body, is provided. The EPU integrally incorporates therein a process section that is necessary for forming a toner image on a photoconductive drum. The belt unit integrally incorporates therein a process section that is necessary for forming the toner image formed on the photoconductive drum by the EPU, onto a paper sheet.

In this manner, in the image forming apparatus having the EPU and the belt unit, conventionally, each unit is separately attached to and removed from the image forming apparatus body. Therefore, a slide rail for guiding the EPU and a slide rail for guiding the belt unit are arranged in the image forming apparatus body.

However, if a slide rail is arranged for each of the EPU and the belt unit, cost reduction may be obstructed by the expensive slide rails. Moreover, since space for installing the slide rails must be secured at two positions in the image forming apparatus body, miniaturization of the apparatus may be obstructed.

Thus, it is desired to develop a processing unit for an image forming apparatus that realizes lower price and miniaturization of the image forming apparatus and that enables smooth attachment and removal of plural process units to and from the image forming apparatus body.

SUMMARY

According to an aspect of the invention, a processing unit for an image forming apparatus is provided that prevents rise in the cost of the image forming apparatus body due to the use of slide rails to attach and remove plural process units and also prevents miniaturization of the apparatus, and that enables smooth attachment and removal of plural process units.

According to an embodiment of the invention, a processing unit for an image forming apparatus includes: a first process unit that has an image carrier and a first process mechanism acting on the image carrier and that is attachable to and removable from an image forming apparatus body; a second process unit that has a second process mechanism acting on the image carrier and that is attachable to and removable from the image forming apparatus body; a regulating member that is provided on the first process unit and regulates a direction of attachment to and removal from the image forming apparatus body; a positioning member that holds the second process unit at a predetermined position in the image forming apparatus body; and a junction member that actuates an operating section and connects the first process unit with the second process unit or disconnects.

DETAILED DESCRIPTION

Figure 1:
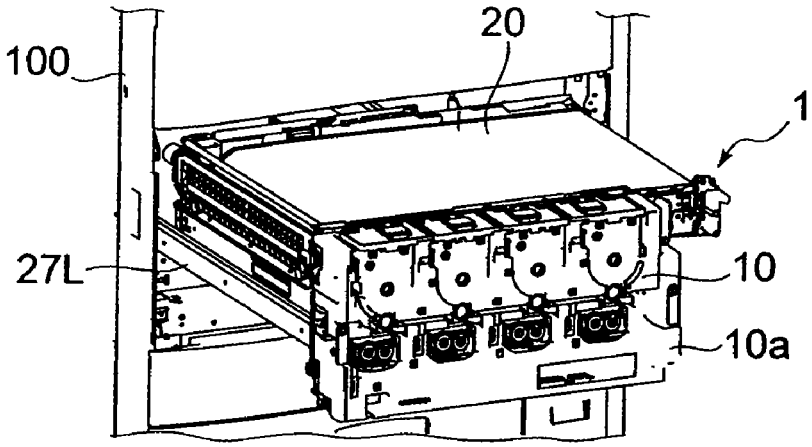
FIG. 1 is a schematic perspective view showing the state where an EPU and a belt unit are integrally drawn out of a body frame of a color copy machine according to an embodiment of the invention.
Figure 2:
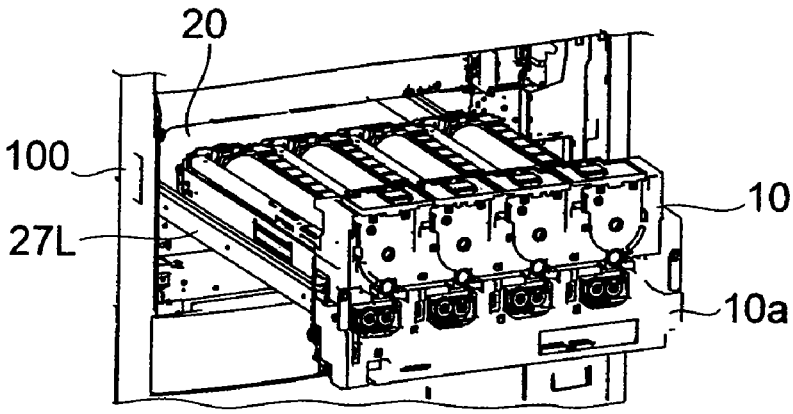
FIG. 2 is a schematic perspective view showing the state where the EPU is drawn out of the body frame of the color copy machine according to the embodiment of the invention.

Hereinafter, an embodiment of the invention will be described in detail with reference to the attached drawings. FIG. 1 shows the state where an EPU 10 as a first process unit constituting an image forming unit 1 and a belt unit 20 as a second process unit are integrally drawn out of a body frame 100 of a four-drum tandem color image forming apparatus, which is an image forming apparatus according to an embodiment of the invention.

Figure 3:
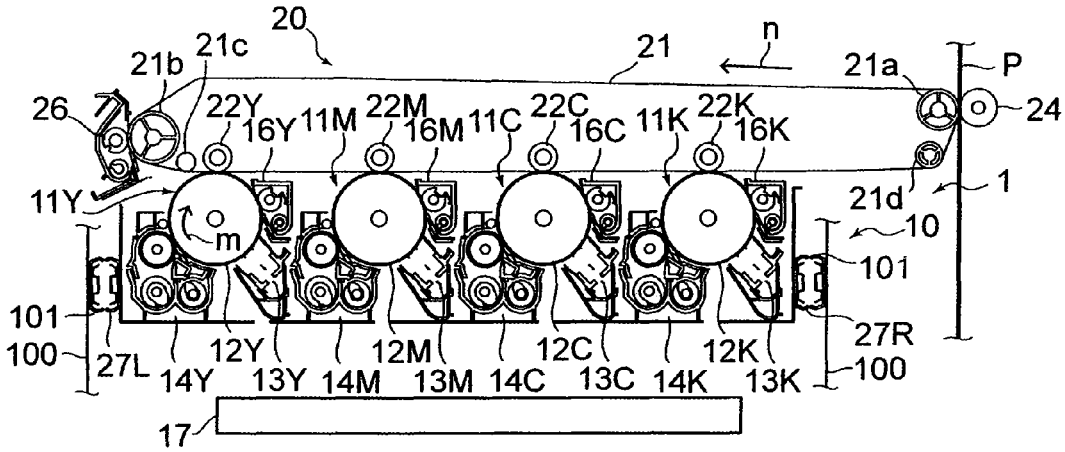
FIG. 3 is a schematic configuration view showing an image forming unit of the color copy machine according to the embodiment of the invention.
Figure 4:
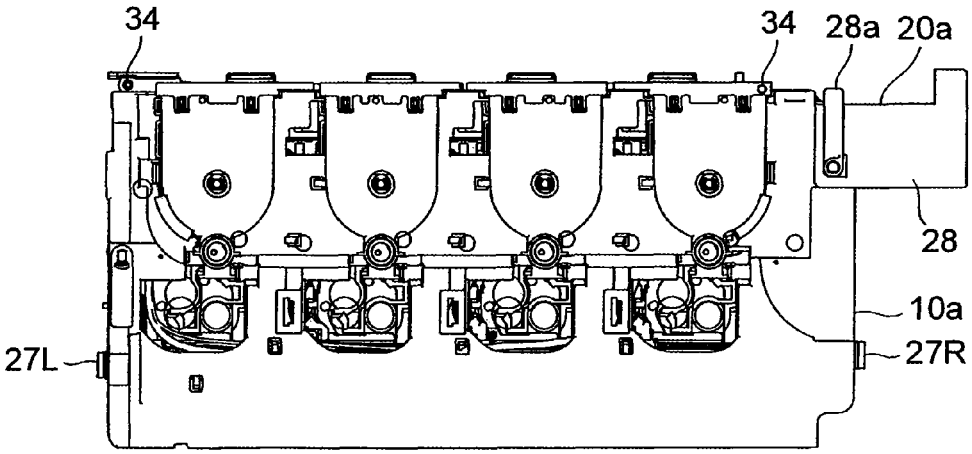
FIG. 4 is a schematic plan view showing the EPU and the belt unit according to the embodiment of the invention, as viewed from the front side.
Figure 5:
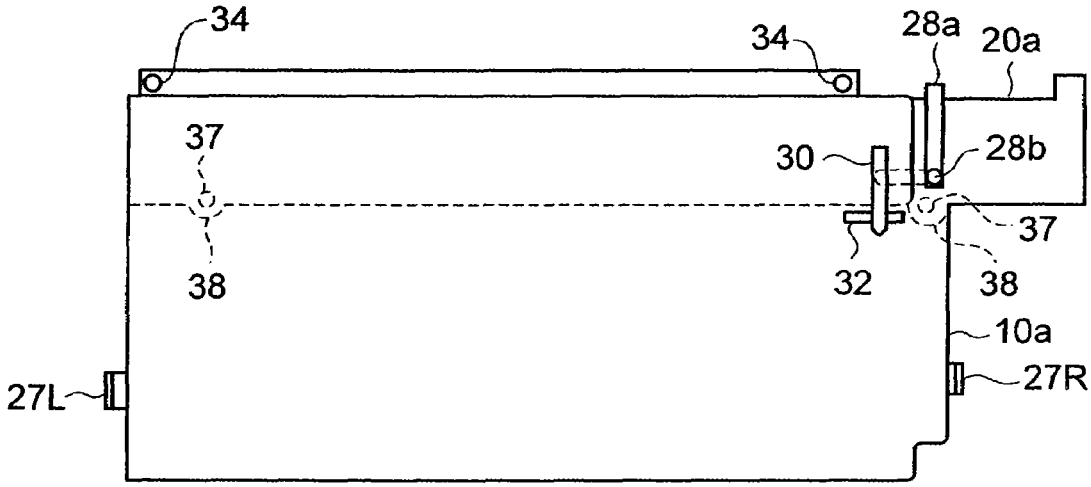
FIG. 5 is a schematic explanatory view showing the connection of an EPU frame and a belt unit frame according to the embodiment of the invention.
Figure 6:
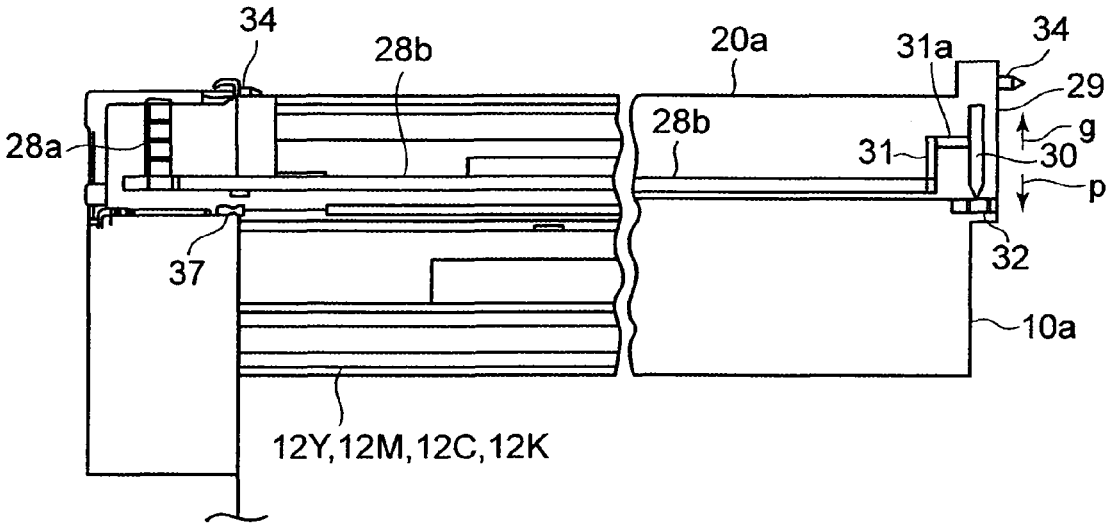
FIG. 6 is a schematic configuration view showing the EPU and the belt unit according to the embodiment of the invention, as viewed from a lateral side.

The EPU 10 of the image forming unit 1 has four process stations 11Y, 11M, 11C and 11K for yellow (Y), magenta (M), cyan (C) and black (K) arranged in parallel along the lower side of the belt unit 20, as shown in FIG. 3. The four process stations 11Y, 11M, 11C and 11K are integrally incorporated in an EPU frame 10*a*.

In the process stations 11Y, 11M, 11C and 11K, chargers 13Y, 13M, 13C and 13K, developing devices 14Y, 14M, 14C and 14K, and photoconductor cleaners 16Y, 16M, 16C and 16K that constitute a first process mechanism are arranged around photoconductive drums 12Y, 12M, 12C and 12K, respectively, which are image carriers rotating in the direction of an arrow m.

Between the chargers 13Y, 13M, 13C and 13K and the developing devices 14Y, 14M, 14C and 14K around the photoconductive drums 12Y, 12M, 12C and 12K, each laser beam is cast from a laser exposure device 17 and each electrostatic latent image is formed on each of the photoconductive drums 12Y, 12M, 12C and 12K. Each of the developing devices 14Y, 14M, 14C and 14K has a two-component developer containing a toner of yellow (Y), magenta (M), cyan (C) or black (K) and a carrier, and supplies the toner to the electrostatic latent image on each of the photoconductive drums 12Y, 12M, 12C and 12K.

The belt unit 20 has an intermediate transfer belt 21 that forms a second process mechanism. The intermediate transfer belt 21 is laid across a backup roller 21*a*, a driven roller 21*b* and tension rollers 21*c* and 21*d* and is driven to turn in the direction of an arrow n. Primary transfer rollers 22Y, 22M, 22C and 22K to perform primary transfer of the toner images on the photoconductive drums 12Y, 12M, 12C and 12K to the intermediate transfer belt 21 respectively are arranged at primary transfer positions on the intermediate transfer belt 21 facing the photoconductive drums 12Y, 12M, 12C and 12K. A belt unit frame 20*a* integrally supports the intermediate transfer belt 21, a driving mechanism provided on its inner circumference, and the primary transfer rollers 22Y, 22M, 22C and 22K.

A secondary transfer roller 24 is arranged at a position facing the backup roller 21*a* on the periphery of the intermediate transfer belt 21. A predetermined secondary transfer bias is applied to the backup roller 21*a*. The secondary transfer roller 24 performs secondary transfer of the toner image on the intermediate transfer belt 21 onto a paper sheet P as a recording medium passing between the intermediate transfer belt 21 and the secondary transfer roller 24. After the secondary transfer ends, a belt cleaner 26 cleans the intermediate transfer belt 21.

Next, the EPU frame 10*a* of the EPU 10 and the belt unit frame 20*a* of the belt unit 20 will be described. Slide rails 27R and 27L that regulate the direction of attachment and removal of the EPU 10 to and from the body frame 100 are provided on the right side and left side of the EPU frame 10*a*. The right-side and left-side slide rails 27R and 27L are guided by guide rails 101 respectively, which are guide members formed on the body frame 100.

A turnable lever 28*a* is provided on a front side 28 of the belt unit frame 20*a*. The lever 28*a* is an operating unit that actuates a bolt 30 as a junction member to connect the EPU frame 10*a* with the belt unit frame 20*a* or to disconnect. The bolt 30 is provided on a rear side 29 of the belt unit frame 20*a* and is slidable in the direction of an arrow p or arrow q. When the bolt 30 is being slid in the direction of the arrow p, the tip of the bolt 30 becomes fitted in a circular hole-shaped insertion port 32 formed on the rear side of the EPU frame 10*a*. As the tip of the bolt 30 is fitted in the insertion port 32, the EPU 10 and the belt unit 20 are connected to each other.

The lever 28*a* causes the bolt 30 to slide via a lever shaft 28*b* and a link 31 attached to the rear side of the lever shaft 28*b*. The link 31 is turnably attached to the lever shaft 28*b* and is interlocked with the turning of the lever 28*a*. A free end 31*a* of the link 31 is fitted with a slit 30*a* of the bolt 30.

When the lever 28*a* is turned in the direction of an arrow r, the bolt 30 is slide in the direction of the arrow q via the link 31. Thus, the bolt 30 is detached from the insertion port 32 and disconnects of the EPU 10 with the belt unit 20. When the lever 28*a* is turned in the direction of an arrow s, the bolt 30 is slide in the direction of the arrow p via the link 31. The tip of the bolt 30 becomes fitted with the insertion port 32.

Positioning pins 34 as positioning members to hold the belt unit 20 in the body frame 100 are provided at left and right positions on the front side 28 and left and right positions on the rear side 29 of the belt unit frame 20*a*. As the positioning pins 34 are inserted into positioning holes formed in the body frame 100, the belt unit 20 is positioned at a position separated from the EPU 10 in the color image forming apparatus.

Figure 8:
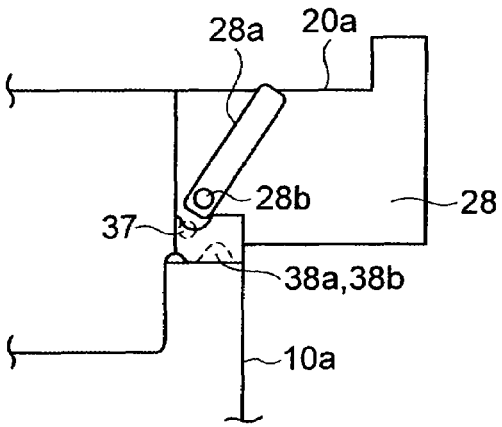
FIG. 8 is an explanatory view showing the state where a piece is away from a supporting section according to the embodiment of the invention, as viewed from the front side.
Figure 9:
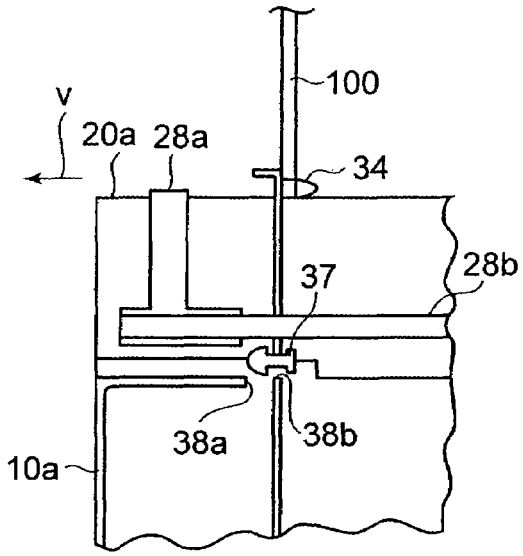
FIG. 9 is an explanatory view showing the state where the piece is away from the supporting section according to the embodiment of the invention, as viewed from a lateral side.
Figure 10:
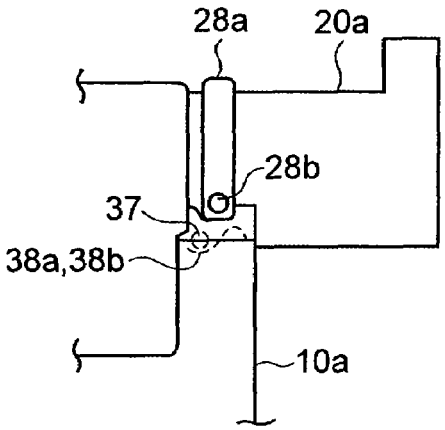
FIG. 10 is an explanatory view showing the state where the piece is fitted with the supporting section according to the embodiment of the invention, as viewed from the front side.
Figure 11:
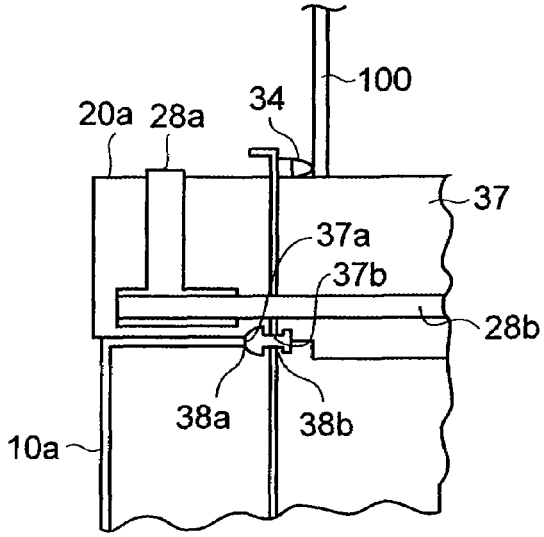
FIG. 11 is an explanatory view showing the state where the piece is fitted with the supporting section according to the embodiment of the invention, as viewed from a lateral side.

Each piece 37 is provided to protrude on the left-and-right bottom surface on the front side 28 of the belt unit frame 20*a*. At the right side, in the state where the EPU 10 and the belt unit 20 are loaded in the body frame 100, supporting sections 38*a* and 38*b* of the EPU 10 face the piece 37 from below. When the positioning pins 34 of the belt unit 20 are inserted in the positioning holes of the body frame 100, the piece 37 is away from the supporting sections 38*a* and 38*b*, as shown in FIG. 8 and FIG. 9. As the belt unit 20 is drawn out toward the front side in the direction of an arrow v, the positioning pins 34 are detached from the body frame 100. Then, the piece 37 is fitted with the supporting sections 38*a* and 38*b*, as shown in FIG. 10 and FIG. 11. At this time, the supporting section 38*a* supports a tip 37*a* of the piece 37. The supporting section 38*b* supports a center recess 37*b* of the piece 37. The supporting sections 38*a* and 38*b* of the EPU 10 of the left-and-right side are same structure.

Figure 7:
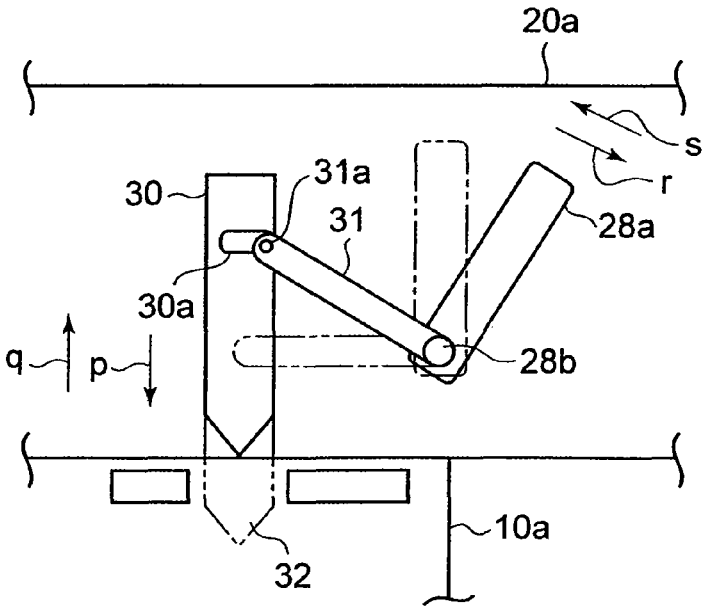
FIG. 7 is a schematic explanatory view showing a connection mechanism of the EPU frame and the belt unit frame according to the embodiment of the invention.

Next, the operation will be described. During image formation performed by the color image forming apparatus, the belt unit 20 of the image forming unit 1 has the positioning pins 34 inserted into the positioning holes formed in the body frame 100 and is thus positioned at a position separated from the EPU 10. At this time, the lever 28*a* is located at the position as indicated by a solid line in FIG. 7. The bolt 30 is detached from the insertion port 32 and the connection of the EPU 10 with the belt unit 20 is canceled.

When an image forming operation is started in such a state and image information is inputted from a scanner, personal computer terminal or the like, the four process stations 11Y, 11M, 11C and 11K of the EPU 10 form toner images respectively. The photoconductive drums 12Y, 12M, 12C and 12K are rotated in the direction of the arrow m and are uniformly charged by the chargers 13Y, 13M, 13C and 13K, respectively. Next, the photoconductive drums 12Y, 12M, 12C and 12K are irradiated with a laser beam corresponding to image information of each color from the laser exposure device 17 and have electrostatic latent images formed thereon. Then, the photoconductive drums 12Y, 12M, 12C and 12K have toner images formed thereon by the developing devices 14Y, 14M, 14C and 14K respectively.

When the toner images on the photoconductive drums 12Y, 12M, 12C and 12K reach the position of the intermediate transfer belt 21 turned in the direction of the arrow n in the belt unit 20, transfer biases are applied to the toner images by the primary transfer rollers 22Y, 22M, 22C and 22K respectively. The toner images are sequentially transferred by primary transfer to the transfer belt 21 and thus form a full-color toner image. Next, the full-color toner image on the intermediate transfer belt 21 is collectively transferred by secondary transfer onto the paper sheet P carried to the position of the secondary transfer roller 24. After that, fixing is conducted on the paper sheet P and the toner image is completed. After the secondary transfer ends, the intermediate transfer belt 21 has the residual toner cleaned by the belt cleaner 26. As for the photoconductive drums 12Y, 12M, 12C and 12K, after the toner images are transferred by primary transfer to the intermediate transfer belt 21, the residual toner is removed by the photoconductor cleaners 16Y, 16M, 16C and 16K respectively. The photoconductive drums 12Y, 12M, 12C and 12K then stand by for the subsequent image formation.

During such image formation, for example, if the some of the chargers 13Y, 13M, 13C and 13K or the developing devices 14Y, 14M, 14C and 14K need to be replaced, the operator draws only the EPU 10 of the image forming unit 1 from the color image forming apparatus body for maintenance.

That is, since the connection of the EPU 10 with the belt unit 20 is usually canceled, the operator opens the front frame of the color image forming apparatus and draws the EPU 10 toward the front side. Thus, the EPU 10 has its right-side and left-side slide rails 27R and 27L guided by the guide rails 101 of the body frame 100 and is drawn toward the front side.

After the EPU 10 is taken out of the body frame 100 and required maintenance is finished, the right-side and left-side slide rails 27R and 27L of the EPU 10 are fitted into the guide rails 101. The EPU 10 is thus loaded in the body frame 100. During this operation, the belt unit 20 remains positioned in the body frame 100.

Meanwhile, if the belt unit 20 requires maintenance during image formation, the operator integrally draws the EPU 10 and the belt unit 20 of the image forming unit 1 from the color image forming apparatus body. That is, the operator opens the front frame of the color image forming apparatus and first connects the EPU 10 with the belt unit 20. To this end, the operator turns the lever 28*a* in the direction of the arrow s to slide the bolt 30 in the direction of the arrow p as indicated by a dot line in FIG. 7. Thus, the tip of the bolt 30 is fitted into the insertion port 32 and the EPU 10 is connected with the belt unit 20.

Next, the EPU 10 is drawn toward the front side in the direction of the arrow v shown in FIG. 9. Thus, the belt unit 20 connected with the EPU 10 slides toward the front side and the positioning pins 34 of the belt unit 20 are detached from the body frame 100. At this time, each piece 37 on the bottom side of the belt unit frame 20*a* fits with each supporting sections 38 of the EPU 10. The belt unit 20 is thus supported by the EPU 10. After that, as the EPU 10 is drawn further toward the front side, the EPU 10 in the state of supporting the belt unit 20 is guided by the guide rails 101 of the body frame and is drawn out toward the front side.

After the EPU 10 and the belt unit 20 are integrally taken out of the body frame 100 and required maintenance is finished, the right-side and left-side slide rails 27R and 27L of the EPU 10 are fitted into the guide rails 101 and the EPU 10 supporting the belt unit 20 is loaded in the body frame 100. At this time, the EPU 10 has its right-side and left-side slide rails 27R and 27L guided by the guide rails 101 and is positioned in the body frame 100. Meanwhile, the belt unit 20 has its positioning pins 34 inserted into the positioning holes formed in the body frame 100 and is positioned in the body frame 100. Thus, each piece 37 on the bottom side of the belt unit frame 20*a* is separated away from each supporting sections 38 of the EPU 10. After that, the operator turns the lever 28*a* in the direction of the arrow r to slide the bolt 30 in the direction of the arrow q shown in FIG. 7. The operator thus removes the bolt 30 from the insertion port 32 and disconnects of the EPU 10 with the belt unit 20. The operator then ends the maintenance and closes the front cover.

According to this embodiment, in the image forming unit 1, when the belt unit 20 is attached to or removed from the body frame 100, the EPU 10 is connected with the belt unit 20 and the EPU 10 and the belt unit 20 are integrally attached or removed, with the EPU 10 supporting the belt unit 20. Therefore, the right-side and left-side slide rails 27R and 27L of the EPU 10, which are guided by the pair of left and right guide rails 101 provided on the body frame 100, can be used also for attaching and removing the belt unit 20. Thus, there is no need to provide any dedicated slide rail and guide rail for attaching and removing the belt unit 20. Therefore, reduction in cost and miniaturization of the color image forming apparatus by saving of space can be realized.

Moreover, in the maintenance of the EPU 10, which requires more frequent maintenance than the belt unit 20, the EPU 10 can be singly attached to and removed from the body frame 100 while the belt unit 20 is kept positioned in the body frame 100. Therefore, there is no deterioration in operability in the maintenance of the EPU 10.

The invention is not limited to the above embodiment and various changes and modifications can be made without departing from the scope of the invention. For example, elements, layout and so on of the first process mechanism in the first process unit are not particularly limited. Moreover, the attachment position and the number of positioning members are not limited. The link mechanism between the operating unit and the junction member is not limited, either.

What is claimed is:

1. A processing unit for an image forming apparatus comprising:

an electrophotographic process unit that has an image carrier and a first process mechanism acting on the image carrier, that is attachable to and removable from an image forming apparatus body, and that forms a toner image on the image carrier;

a belt unit that has a second process mechanism acting on the image carrier, that is attachable to and removable from the image forming apparatus body, and that forms the toner image formed on the image carrier onto a recording medium;

a regulating member that is provided on the electrophotographic process unit and regulates a direction of attachment to and removal from the image forming apparatus body; and an operating section that actuates a junction member which connects or disconnects the electrophotographic process unit and the belt unit.

2. The processing unit according to claim 1, wherein when the electrophotographic process unit and the belt unit are integrally attached to and removed from the image forming apparatus body, the junction member connects the electrophotographic process unit with the belt unit.

3. The processing unit according to claim 2, wherein when the electrophotographic process unit and the belt unit are integrally attached to and removed from the image forming apparatus body, the regulating member regulates the direction of attachment and removal of the electrophotographic process unit and the belt unit.

4. The processing unit according to claim 2, wherein the electrophotographic process unit has a supporting section to support the belt unit when the electrophotographic process unit and the belt unit are integrally attached to and removed from the image forming apparatus body.

5. The processing unit according to claim 1, wherein when the electrophotoqraphic process unit is singly attached to and removed from the image forming apparatus body, the junction member disconnects the electrophotographic process unit and the belt unit.

6. The processing unit according to claim 1, wherein the junction member has a first connection section provided in the electrophotographic process unit and a second connection section provided in the belt unit, and the operating section actuates the junction member to fit the first connection section with the second connection section or to cancel the fitting.

7. The processing unit according to claim 1, further comprising a positioning member that holds the belt unit at a predetermined position in the image forming apparatus body.

8. The processing unit according to claim 7, wherein the positioning member holds the belt unit at the predetermined position in the image forming apparatus body or is capable of release at the predetermined position, in accordance with slide movement of the belt unit, and a supporting section configured to support the belt unit when the positioning member releases at the predetermined position.

9. An image forming apparatus comprising:

a body frame;

an electrophotographic process unit that has an image carrier and a first process mechanism acting on the image carrier, that has a regulating member regulating a direction of attachment to and removal from the body frame, that is attachable to and removable from the body frame, and that forms a toner image on the image carrier;

a belt unit that has a second process mechanism acting on the image carrier, that is attachable to and removable from the body frame, and that forms the toner image formed on the image carrier onto a recording medium;

an operating section that actuates a junction member which connects or disconnects the electrophotographic process unit and the belt unit; and a guide member that is provided on the body frame and guides the regulating member.

10. The apparatus according to claim 9, wherein when the electrophotographic process unit and the belt unit are integrally attached to and removed from the body frame, the junction member connects the electrophotographic process unit with the belt unit.

11. The apparatus according to claim 9, wherein when the electrophotographic process unit and the belt unit are integrally attached to and removed from the body frame, the regulating member is guided by the guide member in the direction of attachment and removal of the electrophotographic process unit and the belt unit.

12. The apparatus according to claim 9, wherein the electrophotographic process unit has a supporting section to support the belt unit when the electrophotographic process unit and the belt unit are integrally attached to and removed from the body frame.

13. The apparatus according to claim 9, wherein when the electrophotographic process unit is singly attached to and removed from the body frame, the junction member disconnects the electrophotographic process unit and the belt unit.

14. The apparatus according to claim 9, wherein the junction member has a first connection section provided in the electrophotographic process unit and a second connection section provided in the belt unit, and the operating section actuates the junction member to fit the first connection section with the second connection section or to cancel the fitting.

15. The apparatus according to claim 9, further comprising a positioning member that holds the belt unit at a predetermined position in the body frame.

16. The apparatus according to claim 15, wherein the positioning member holds the belt unit at the predetermined position in the body frame or is capable of release at the predetermined position, in accordance with slide movement of the belt unit, and a supporting section configured to support the belt unit when the positioning member releases at the predetermined position.

17. A method of attaching and removing a processing unit, comprising:

connecting an electrophotographic process unit that forms a toner image on an image carrier with a transfer belt unit on which the toner image formed on the image carrier is transferred;

guiding a regulating member provided on the electrophotographic process unit by a guide member provided on a body frame, and attaching and removing the electrophotographic process unit and the transfer belt unit that are connected with each other, to and from the body frame; and guiding the regulating member provided on the electrophotographic process unit by the guide member provided on the body frame, and attaching and removing only the electrophotographic process unit is attached to and removed from the body frame when the electrophotographic process unit and the transfer belt unit are not connected with each other.

18. The method according to claim 17, wherein when only the electrophotographic process unit is attached to and removed from the body frame, the transfer belt unit is positioned at a predetermined position in the body frame.

* * * * *